US007908702B2

(12) United States Patent
Accumanno

(10) Patent No.: US 7,908,702 B2
(45) Date of Patent: Mar. 22, 2011

(54) CAULK REMOVER AND SMOOTHER

(75) Inventor: Mario Bernardo Accumanno, East Hanover, NJ (US)

(73) Assignee: Red Devil, Incorporated, Tulsa, OK (US)

( * ) Notice: Subject to any disclaimer, the term of this patent is extended or adjusted under 35 U.S.C. 154(b) by 1133 days.

(21) Appl. No.: 11/371,950

(22) Filed: Mar. 10, 2006

(65) Prior Publication Data

US 2007/0209216 A1 Sep. 13, 2007

(51) Int. Cl.
*E01C 19/12* (2006.01)
*E04F 21/165* (2006.01)

(52) U.S. Cl. ..... 15/235.7; 15/105.5; 15/235.3; 15/236.05; 15/236.09

(58) Field of Classification Search ..... 15/105, 15/105.5, 235.3, 235.7, 236.01, 236.05, 236.06, 15/236.09; D8/45, 14; D7/643, 644, 645; D10/46.3; 30/152, 153
See application file for complete search history.

(56) References Cited

U.S. PATENT DOCUMENTS

| | | | | | |
|---|---|---|---|---|---|
| 153,119 | A | * | 7/1874 | Schofiled | 7/118 |
| 708,806 | A | * | 9/1902 | Garda | 30/143 |
| 1,998,969 | A | * | 4/1935 | Schauer | 73/426 |
| 2,237,378 | A | * | 4/1941 | Thienemann | 33/501 |
| 3,030,812 | A | * | 4/1962 | Lutz | 73/426 |
| 3,400,591 | A | * | 9/1968 | Larson | 73/426 |
| 4,006,613 | A | * | 2/1977 | Zion | 70/394 |
| D247,412 | S | * | 3/1978 | Montesi | D10/46.3 |
| 4,673,346 | A | * | 6/1987 | Anderson | 425/458 |
| 4,879,780 | A | * | 11/1989 | Prebeck | 15/105.5 |
| 5,255,438 | A | * | 10/1993 | Morgan | 30/254 |
| 5,437,074 | A | * | 8/1995 | White et al. | 15/105 |
| 6,035,536 | A | * | 3/2000 | Dewberry | 30/169 |
| 6,128,805 | A | * | 10/2000 | Rivera | 16/111.1 |
| D433,901 | S | * | 11/2000 | Hepworth | D8/45 |
| 6,578,229 | B1 | * | 6/2003 | Dziallas et al. | 15/236.05 |
| 7,047,588 | B2 | * | 5/2006 | Bennett | 15/105.5 |
| 7,346,986 | B2 | * | 3/2008 | Feith | 30/92 |
| 2006/0053638 | A1 | * | 3/2006 | Sumner-Trivisani et al. | 30/298.4 |

* cited by examiner

*Primary Examiner* — Randall Chin
(74) *Attorney, Agent, or Firm* — McAfee & Taft

(57) ABSTRACT

A caulk tool, comprising a caulk remover blade, a caulk smoother blade, and a hinge connecting the caulk remover blade and the caulk smoother blade. The caulk remover blade and the caulk smoother blade can pivot with respect to one another about the hinge.

7 Claims, 4 Drawing Sheets

FIG. 6
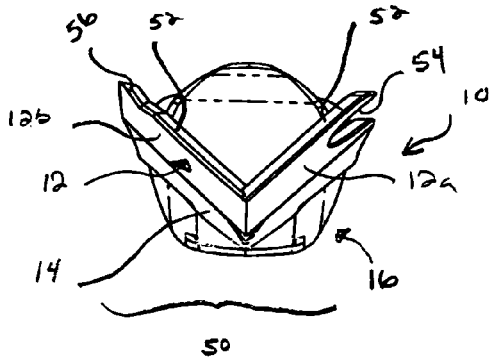
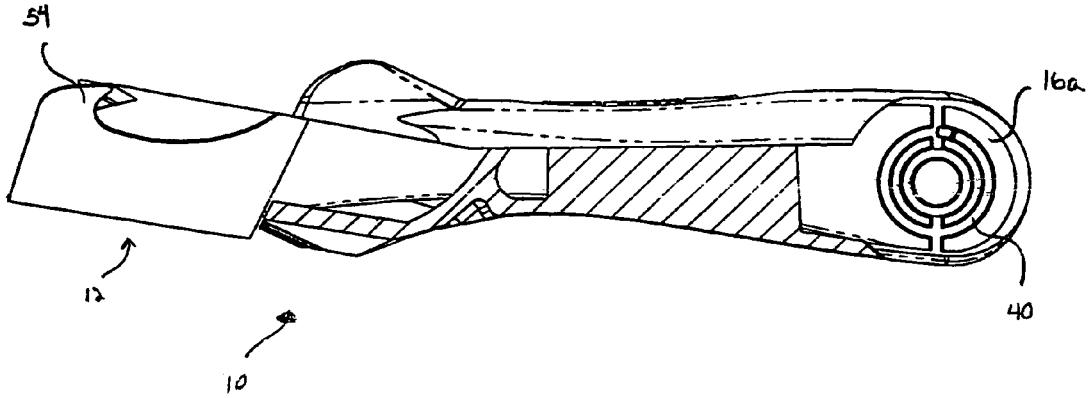
FIG. 7

CAULK REMOVER AND SMOOTHER

BACKGROUND OF THE INVENTION

1. Field of the Invention

The present invention relates generally to tools, and more particularly, to tools for removing and/or smoothing caulk, putty, sealant, or similar materials (referred to collectively herein as "caulk").

2. Related Art

Most caulks have a finite life span and tend to crack or peel over time. As a result, the old caulk periodically needs to be removed and replaced with new caulk. This typically involves cutting, scraping, and pulling the old caulk out of the seam, and subsequently applying new caulk to the seam, for example, by squirting it out of a tube or a caulk gun. The new caulk applied from a tube or caulk gun often needs to be pressed deeply into the seem, and/or smoothed out. This can be achieved using, for example, the installer's finger or a caulk smoother tool. Out of convenience, prior art tools have been developed that include both a caulk remover portion and a caulk smoother portion. These tools, however, often involve compromises in the caulk remover portion and/or the caulk smoother portions. In addition, these tools are often lacking in ergonomics (e.g., they are not comfortable to hold and use). Therefore, there remains a need in the art for a caulk remover and smoother tool that overcomes these and other shortcomings of the prior art.

BRIEF SUMMARY OF THE INVENTION

The present invention relates to a dual-function caulk tool that can be used, for example, for caulking around tubs, sinks, windows, doors and other areas. The caulk tool provides an easy solution for both removing old caulk and applying new.

According to an exemplary embodiment, the present invention relates to a caulk tool, comprising a caulk remover blade, a caulk smoother blade, and a hinge connecting the caulk remover blade and the caulk smoother blade. The caulk remover blade and the caulk smoother blade can pivot with respect to one another about the hinge.

According to another exemplary embodiment, the present invention relates to a caulk tool, comprising a handle comprising first and second handle portions pivotable with respect to one another between open and closed positions, a caulk scraper blade connected to the first handle portion, and a caulk smoother blade connected to the second handle portion.

According to still another exemplary embodiment, the present invention relates to a caulk tool, comprising a caulk scraper blade, a caulk smoother blade movable with respect to the caulk scraper blade, and a handle interconnecting the caulk scraper blade and the caulk smoother blade.

According to yet another exemplary embodiment, the present invention relates to a caulk tool, comprising a folding handle comprising first and second handle portions pivotable between open and closed positions, the first and second handle portions nesting with one another when in the closed position, a caulk scraper blade connected to the first handle portion, and a caulk smoother blade connected to the second handle portion.

Further objectives and advantages, as well as the structure and function of preferred embodiments will become apparent from a consideration of the description, drawings, and examples.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

FIG. 6 is a front view of the exemplary caulk tool of FIG. 1, shown in the closed position; and FIG. 7 is a partial cross-sectional view of the exemplary caulk tool of FIG. 1, shown in the closed position, and taken along line VII-VII of FIG. 4.

DETAILED DESCRIPTION OF THE INVENTION

Figure 1:
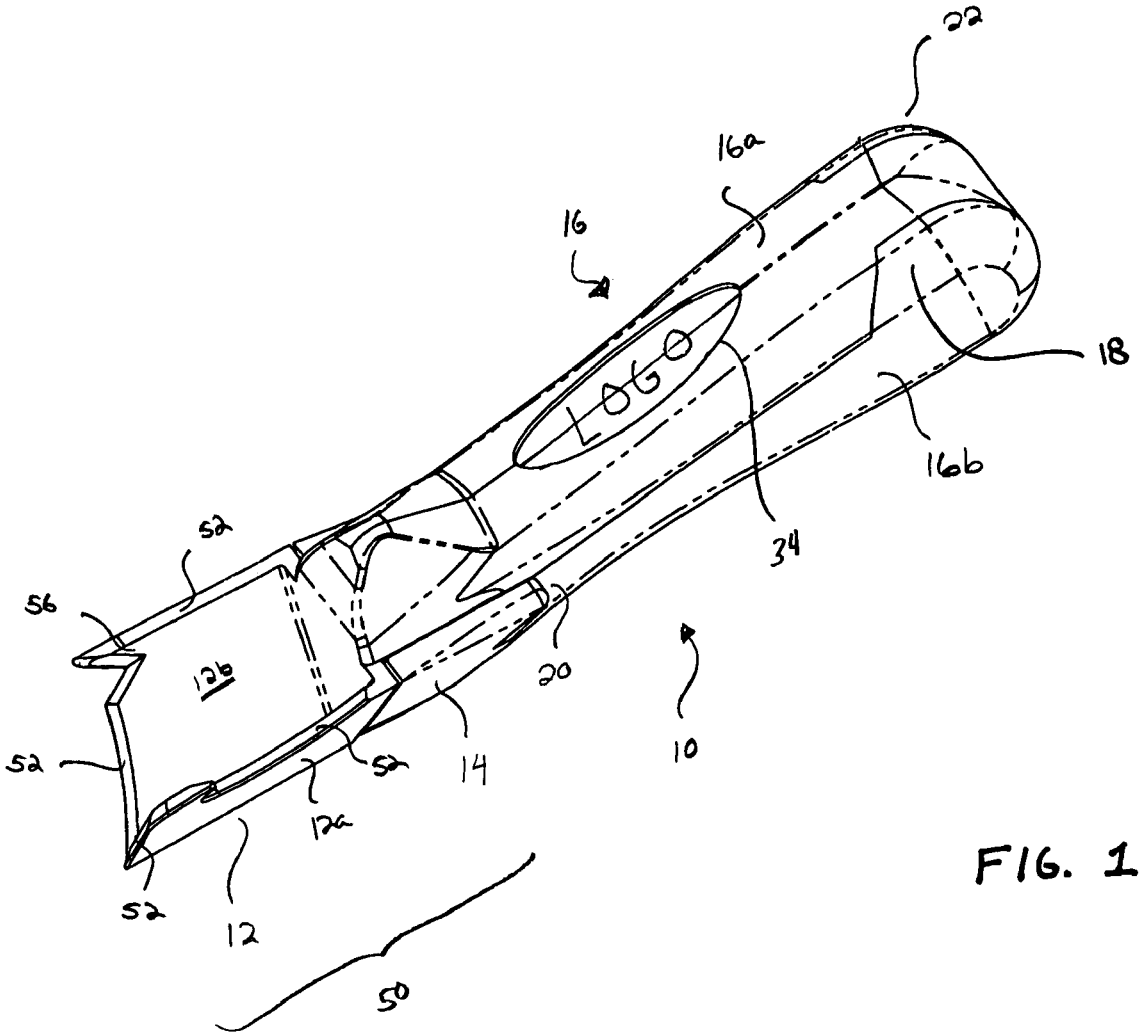
FIG. 1 is a perspective view of an exemplary caulk tool according to the present invention, shown in a closed position.

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention. All references cited herein are incorporated by reference as if each had been individually incorporated.

Referring to FIGS. 1-7, an exemplary embodiment of a caulk tool according to the present invention is shown. Caulk tool 10 generally includes a caulk remover blade 12 and a caulk smoother blade 14. The caulk remover blade 12 and the caulk smoother blade 14 can be interconnected by, for example, a handle 16. The caulk remover blade 12 and the caulk smoother blade 14 can move (e.g., pivot) with respect to one another between a closed position (shown in FIG. 1) and one or more open positions (shown in FIG. 2). When in the closed position, the caulk remover blade 12 can be used, for example, to cut, scrape, or otherwise remove old, degraded caulk from a surface, such as a countertop or window. When in the open position, the caulk smoother blade 14 can be used in addition to the caulk remover blade 12, for example, to smoothen freshly applied caulk, and/or to remove excess unhardened caulk from the surface. The relatively compact arrangement of the caulk tool 10 when in the closed position facilitates safe, easy, and space-efficient storage and transport of the caulk tool 10. The closed position can also cause the two blades 12, 14 to protect and reinforce one another, and this in turn can help prevent product breakage (e.g., when the tool 10 is stored underneath other tools or when the tool 10 is accidentally stepped on).

Figure 2:
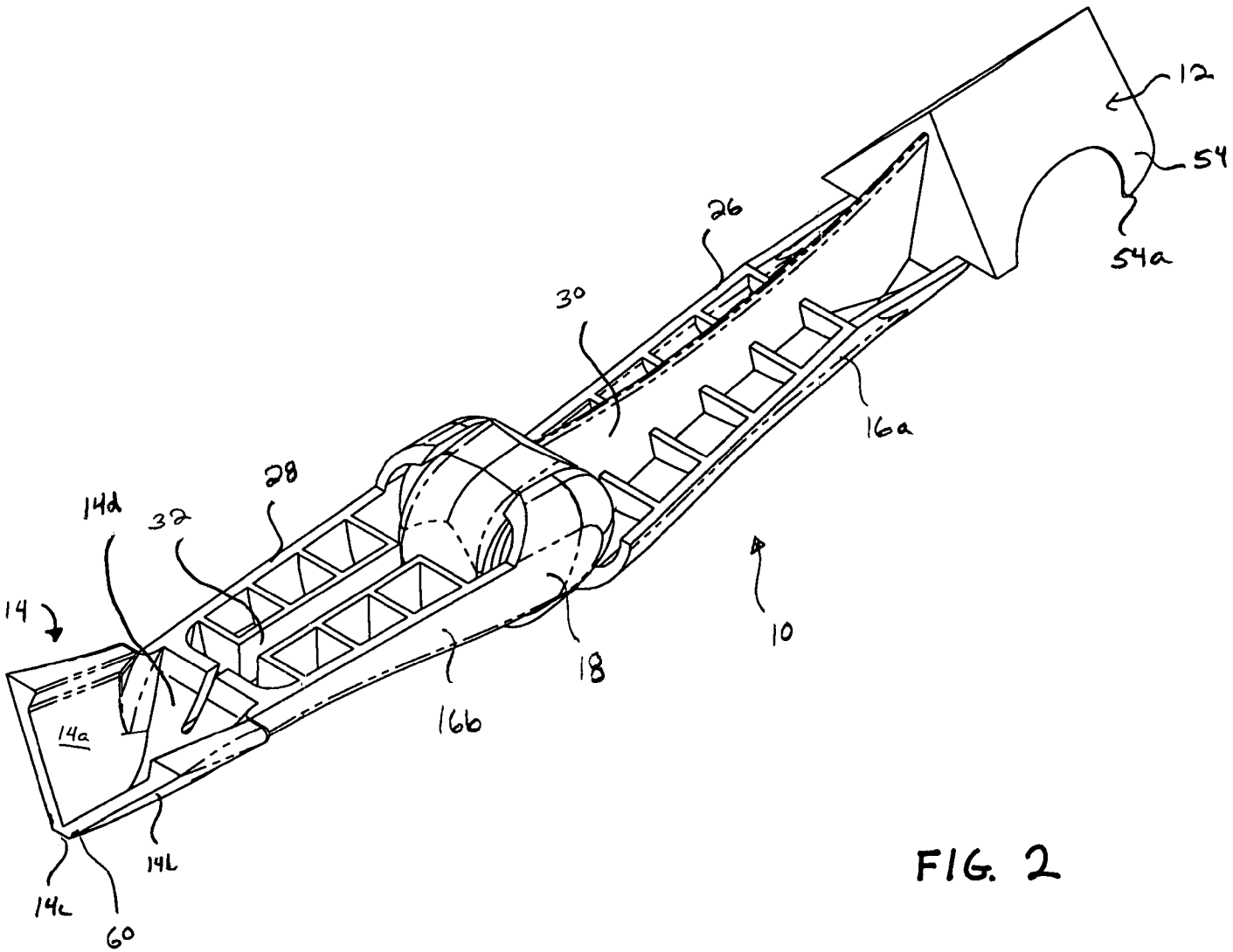
FIG. 2 is a perspective view of the exemplary caulk tool of FIG. 1, shown in an open position.

As best shown in FIG. 2, the handle 16 can comprise a foldable design including a first handle portion 16*a* and a second handle portion 16*b*. The first and second handle portions 16*a*, 16*b* can move (e.g., pivot) with respect to one another, for example, about a hinge 18. The caulk remover blade 12 can be connected to the first handle portion 16*a*, and the caulk smoother blade 14 can be connected to the second handle portion 16*b*, or vice versa. As a result, movement of the first and second handle portions 16*a* and 16*b* can facilitate movement of the blades 12, 14 between the open and closed positions. A locking mechanism (not shown) can be provided on the first and second handle portions 16*a*, 16*b* to retain the handle portions 16*a*, 16*b* in the closed position. Additionally or alternatively, a locking mechanism (not shown) can be provided to retain the handle portions 16*a*, 16*b* in the open position. Any number of locks known in the art, such as snap-type locks, latches, etc., can be used as the locking mechanism(s).

According to an alternative embodiment, the handle can be unitary or otherwise non-folding, and one or more of the blades 12, 14 can be hinged or otherwise movably attached thereto. In the exemplary embodiment shown, the blades 12, 14 are formed integrally with the respective handle portions 16*a*, 16*b*. One of ordinary skill in the art will appreciate, however, that the blades 12, 14 can be formed separately from the handle portions 16*a*, 16*b* and attached thereto, for example, using fasteners, hinges, adhesives, or other attachment methods known in the art.

Referring to the exemplary embodiment of FIG. 1, the handle 16 can define first and second ends 20, 22, that are spaced apart from one another along the longitudinal axis of the handle 16 (when in the closed position). In the exemplary embodiment shown, the caulk remover blade 12 and/or the caulk smoother blade 14 can be located substantially adjacent one of the ends, with the hinge 18 located substantially adjacent the other of the ends. For example, as shown in FIG. 1, the blade 12 and/or 14 can be located substantially adjacent the first end 20, and the hinge 18 can be located substantially adjacent the second end 22 (when the handle 16 is in the closed position). One of ordinary skill in the art will know, however, that alternative embodiments are possible. For example, the hinge 18 can be located somewhere intermediate the first and second ends 20, 22 of the handle 16.

Figure 3:
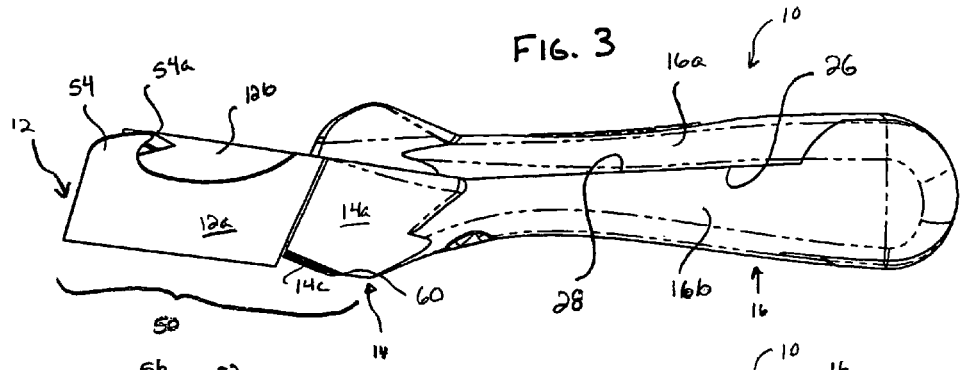
FIG. 3 is a side view of the exemplary caulk tool of FIG. 1, shown in the closed position.
Figure 4:
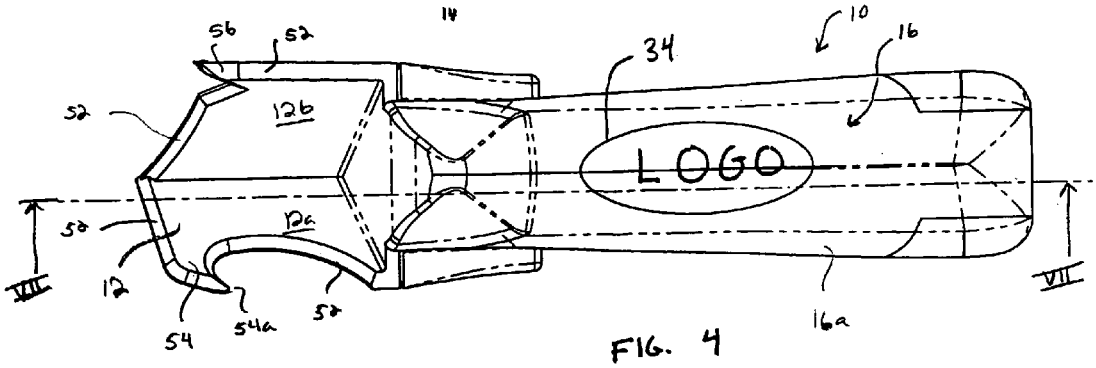
FIG. 4 is a top view of the exemplary caulk tool of FIG. 1, shown in the closed position.
Figure 5:
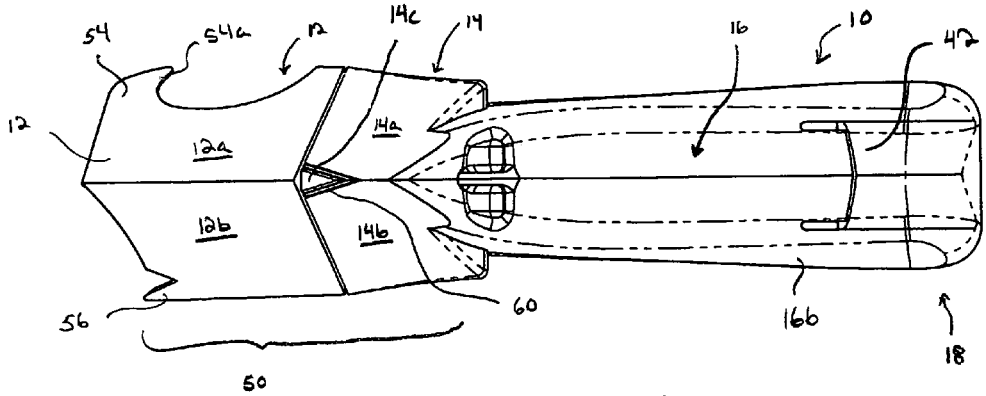
FIG. 5 is a bottom view of the exemplary caulk tool of FIG. 1, shown in the closed position.

Referring particularly to FIGS. 1 and 3, the handle 16 can be smooth and ergonomically contoured to fit comfortably in a user's hand. The first and second handle portions 16*a*, 16*b* can nest when in the closed position. More specifically, as shown in FIG. 2, the first handle portion 16*a* can include an under surface 26 and the second handle portion 16*b* can include an upper surface 28. The undersurface 26 and the upper surface 28 can be substantially complimentary to one another to provide a mating or nesting fit between the first and second handle portions 16*a*, 16*b* when in the closed position (as shown in FIG. 3). Because handle portion 16*b* is shorter in length than first handle portion 16*a*, smoother blade 14 will also nest with first handle portion 16*a* as shown in FIGS. 3 and 5. As shown in FIG. 2, the first handle portion 16*a* and/or the second handle portion 16*b* can be substantially hollow and can include ribs, lattice, or other reinforcing structures known in the art. In the exemplary embodiment shown, the first handle portion 16*a* includes a longitudinal reinforcing rib 30 and the second handle portion 16*b* includes a longitudinal slot 32 into which the longitudinal rib 30 fits when the tool 10 is in the closed position. One of ordinary skill in the art will know, however, that alternative configurations are possible. As shown in FIGS. 1 and 4, a recess 34 may be located in an upper portion of the handle 16 and a logo or other writing/decoration can be embossed or otherwise provided in the recess 34.

Referring to FIGS. 2 and 7, the hinge 18 can comprise an opposing pair of circular bosses 40 (FIG. 7, only one of pair shown) located on the first handle portion 16*a*, and a corresponding pair of recesses (hidden from view) located in the second handle portion 16*b*, or vice versa. The bosses 40 can engage the recesses to provide the hinge 18. One of ordinary skill in the art will know, however, that other types of hinges can alternatively be used. For example, a pin, screw, or other type of hinge/pivot assembly known in the art can alternatively be used. Referring to FIG. 5, the second handle portion 16*b* can include a leaf spring arrangement 42 located proximate the hinge 18. The leaf spring 42 can engage a portion of the first handle portion 16*a* upon full extension of the folding handle 16 to the open position in order to avoid over-extension and/or breakage of the handle 16 or hinge 18.

Referring to FIGS. 1, 3, 5, and 6, the caulk remover blade 12 and the caulk smoother blade 14 can be located near one another when in the closed position. Both of these blades can have a substantially V-shaped profile (see FIG. 6). The blades 12, 14 can be shaped and dimensioned so that they define a substantially V-shaped common outer surface 50 when in the closed position. The V-shaped configuration can guide the caulk smoother blade 14 along a corner surface, such as the intersection of a wall and countertop, and can also provide a clearance between the caulk smoother blade 14 and the corner. One of ordinary skill in the art will know that the blades 12, 14 can alternatively define common surfaces having shapes other than V-shaped, for example, U-shaped, rounded, multi-angled, etc.

Referring to FIGS. 1 and 4-6, the exemplary embodiment of the caulk removing blade 12 will be described. The caulk removing blade 12 can include a first blade section 12*a* and a second blade section 12*b*. The first and second blade sections 12*a*, 12*b* can be angled with respect to one another, defining the V-shaped profile mentioned above. According to one exemplary embodiment, the blade sections 12*a*, 12*b* are substantially perpendicular to one another, however, other angles are possible. This arrangement may be advantageous when removing caulk from two perpendicular surfaces, such as an abutting wall and countertop, for example. The leading edge of the blade sections 12*a*, 12*b* can include beveled knife edges 52. The beveled knife edge 52 can additionally or alternatively extend across the upper surfaces of the blade sections 12*a*, 12*b*. One of the blade sections 12*a*, 12*b* can include a sharp hook 54, preferably having its point 54*a* pointing back toward the handle. The hook 54 can be useful, for example, to grip and pull old caulk out from tight spaces. The other of the blade sections 12*a*, 12*b* can include a gouge point 56. The gouge point 56 can be a sharp point defined by a notch in the leading edge of one of the blade sections 12*a*, 12*b*. The gouge point 56 can be useful for piercing or cutting objects, or forming a gouge into a flat surface. The exemplary configuration of the caulk remover blade 12 shown and described has been found to remove old caulk without scratching surfaces. However, one of ordinary skill in the art will know that the caulk remover blade 12 is not limited to the V-shaped configuration shown and described, and that other configurations known in the art can alternatively be implemented.

Referring to FIG. 2, the caulk smoother blade 14 can comprise a pair of side walls 14*a*, 14*b* that are angled with respect to one another, for example, to form a substantially V-shaped profile. In the exemplary embodiment shown, the side walls 14*a*, 14*b* are substantially perpendicular to one another, which can be useful when, for example, smoothing a caulk bead between two perpendicular surfaces, such as two walls or a wall and a countertop. One of ordinary skill in the art will know that other angles are possible as well. The caulk smoother blade 14 can also comprise a truncated bead forming portion 14*c* located at the intersection of the side walls 14*a*, 14*b* near the leading edge of the caulk smoother blade 14 (see FIGS. 2, 3, 5). When the side walls 14*a*, 14*b* of the caulk smoothing blade 14 are slid along adjoining surfaces to which fresh caulk has been applied, the bead forming portion 14*c* aligns with the corner formed by the two surfaces and provides a clearance through which a predetermined amount of the freshly applied caulk passes. As a result, the leading edges of the caulk smoother blade 14 remove any excess caulk, while the bead forming portion 14*c* creates a smooth, consistent bead of caulk. The caulk smoother blade 14 can include score lines 60, or other indents or indicia, indicating where a user can remove material from the side walls 14*a*, 14*b* to enlarge the size of the truncated bead forming portion 14*c* and the resultant bead of caulk. Referring to FIG. 2, the caulk smoother blade 14 can also comprise a rear wall 14*d*. The side walls 14*a*, 14*b*, together with the rear wall 14*d* can comprise a collector portion adapted to collect excess caulk that is removed during the smoothing operation. One of ordinary skill in the art will know that the caulk smoother blade 14 is not limited to the V-shaped configuration shown and described, and that alternative embodiments are possible.

The blades 12, 14, and the handle 16 can be made from plastic materials, such as polypropylene, polyacrylate, or polyethylene. For example, these components can be injection or compression molded. Alternatively, one or more of these components can be made from metal materials, such as steel or titanium. Alternatively, one or more of the components can be made from ceramic, composite, or carbon fiber materials. Alternatively, various combinations of the above-identified materials can be used. For example, the handle 16 can be made of metal (e.g., die cast metal) and the blades 12, 14 can be made of plastic. In addition, the blades 12, 14 can be removable/replaceable, using structures known in the art, in order to allow the blades 12, 14 to be replaced in the event that they wear out. One of ordinary skill in the art will know that the above-mentioned list of materials is not exhaustive, and that other materials and combinations of materials known in the art can alternatively be used.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed:

1. A caulk tool, comprising:

a caulk remover blade;

a caulk smoother blade;

a handle comprising first and second handle portions connected to the caulk remover blade and the caulk smoother blade, respectively; and a hinge connecting the first handle portion and the second handle portion wherein the first handle portion and the second handle portion pivot with respect to one another between open and closed positions and the first handle portion and the second handle portion nest when in the closed position, the first and second handle portions having different lengths such that in the closed position one of the caulk smoother blades and caulk remover blades nests with the handle portion to which it is not connected.

2. The caulk tool of claim 1, wherein the handle defines first and second longitudinally opposed ends in the closed position, with the caulk remover blade and the caulk smoother blade located substantially adjacent the first end, and the hinge located substantially adjacent the second end.

3. The caulk tool of claim 1, wherein the caulk remover blade and the caulk smoother blade pivot with respect to one another between the open and closed positions, and the caulk remover blade and the caulk smoother blade together define a common substantially V-shaped surface when in the closed position.

4. The caulk tool of claim 1, wherein the caulk smoother blade comprises a collector portion adapted to collect excess caulk.

5. The caulk tool of claim 1, wherein the caulk smoother blade has a substantially V-shaped profile.

6. The caulk tool of claim 1, wherein the caulk remover blade comprises first and second blade sections that are angled with respect to one another, with the first blade section including a hook and the second blade section including a gouge point.

7. The caulk tool of claim 1, wherein the caulk smoother blade nests with the first handle portion.

* * * * *